US005417135A

United States Patent [19]

Straubinger

[11] Patent Number: 5,417,135

[45] Date of Patent: May 23, 1995

[54] PAD ASSEMBLY, PAD CUP, AND RETAINER FOR WIND INSTRUMENTS, PARTICULARLY FLUTES AND CLARINETS

[76] Inventor: David Straubinger, 2521 E. Southport Rd., Indianapolis, Ind. 46227

[21] Appl. No.: 44,273

[22] Filed: Apr. 7, 1993

[51] Int. Cl.[6] ..... G10D 7/08

[52] U.S. Cl. ..... 84/385 P

[58] Field of Search ..... 84/385 P

[56] References Cited

U.S. PATENT DOCUMENTS

| | | | |
|---|---|---|---|
| 3,688,633 | 9/1972 | Nagao | 84/380 |
| 4,704,939 | 11/1987 | Straubinger | 84/385 |
| 4,798,122 | 1/1989 | Gisler et al. | 84/385 P |
| 5,183,954 | 2/1993 | Wasser | 84/385 P |

*Primary Examiner*—Howard B. Blankenship
*Assistant Examiner*—Patrick J. Stanzione
*Attorney, Agent, or Firm*—Edward E. Sowers

[57] ABSTRACT

A sealing pad assembly for closure of a wind instrument's tone hole and device for containing and securing the pad assembly. The pad's felt backing provides a soft support over the sealing surface of the tone hole to minimize noise but has a firm outer and central regions to minimize deformation of the pad surface and damage from abrasive contacts and to optimize the instrument's tone. The pad cup and retainer are designed to allow the retainer to pivot when the pad is leveled. As a result, stress is relieved which could otherwise damage the pad's surface or cause the pad nut to break away from the pad cup.

11 Claims, 6 Drawing Sheets

PAD ASSEMBLY, PAD CUP, AND RETAINER FOR WIND INSTRUMENTS, PARTICULARLY FLUTES AND CLARINETS

BACKGROUND

This invention relates generally to a tone hole covering assembly for wind instruments and to a novel pad cup and retainer which allows adjustment of the pad without causing damaging stress on the pad or pad cup-retainer combination. Although generally applicable to all wood-wind instruments, one embodiment of the tone hole covering assembly or pad assembly is especially suited for use in clarinets and the novel pad cup and retainer are especially suited for use in flutes.

During this century, instrument pads have typically comprised a cardboard backed wool felt disk covered with Goldbeater's skin, wrapped around the cardboard and glued to its backside. The pad is fixed in a pad cup, sealing side exposed, and the combination mounted over an instrument tone hole on a hinged mechanism so that the tone hole is sealed when the pad is in its closed position. Typically, the back or hinged side of the pad remains closer to the tone hole in the pad's open position. The inability of the tone hole to close tightly with minimal pressure affects the instrument's tone and the player's technique. An instrument pad only 0.001 of an inch out of adjustment produces an air leak detectable by the player.

Although this pad can initially be made to seal well, it needs frequent adjustments or replacement when subjected to changes in humidity, temperature, and altitude. Under humid conditions, the felt, composed of wool fibers, adsorbs moisture from the atmosphere causing the entire pad to expand. When the player depresses such a pad, its back touches the tone hole first leaving a gap in front where air leaks. Under conditions of low humidity, the felt pad releases moisture causing the entire pad to shrink. As a result, the pad, when depressed normally, will touch the front of the tone hole first, leaving a gap at the back where air leaks. Changes in temperature or altitude similarly cause changes in the felt backing. To further complicate matters, the skin similarly expands and contracts depending on its environment. This lack of dimensional stability of the felt and skin causes the pad surface to loose its integrity and is the primary cause of air leaks at the pad-tone hole interface.

Finally, the felt backing typically exhibits a variable density or distribution of fibers. In the areas having fewer fibers, soft spots occur where the felt cannot adequately support the skin. Shrinkage of the skin and usage compress these areas more than surrounding areas. As a result, the skin is no longer held to the tone hole and air leaks develop at the pad-tone hole interface.

Regardless of the source of small air leaks, the player can usually compensate by applying more pressure against the pad at the expense of his technique. As the leaks become more severe, the player can no longer compensate and his tone and response suffer.

In 1987, in U.S. Pat. No. 4,704,939, a new pad was disclosed that can maintain a flat sealing surface regardless of variations in temperature, moisture, or altitude. As a result of this design, pad life is extended and closure of the tone hole consistently requires only a light touch by the musician. To accomplish these advantages, the new pad has a semi-rigid supporting unit for the felt.

The pad's design allows its surface to be tilted to fit a tone hole with a perfectly planar surface through the leveling process of triangulation or, by a wedging action, to distort the planar surface to perfectly match a damaged or imperfect tone hole. Both leveling techniques may be used on the same pad.

The new pads are constructed by stretching a skin across a cushion ring fitted within a recess on the lower radial face of a rigid backing disk having a bendable lower margin. The skin is folded around the edge of the backing disk and secured to the disk's back side. The pad is secured to its cup with a retainer comprising a flat washer and screw combination attached to a pad nut which is in turn attached to the bottom of the pad cup and centrally located within the cup's cavity. Alternatively, the backing disk having a threaded hole centrally located to secure the flat washer and screw combination can be secured to the cup with an adhesive. As before, the flat washer and screw combination secures the pad within its cup. One embodiment of the improved pad allows for further adjustment by bending or flexing the pad or a portion of the pad with a specially designed tool. A second embodiment of the new pad allows for further adjustment by placing complete or partial shims between the rigid and bendable portions of the backing disk. When partial shims are used and the screw holding the flat washer against the sealing surface is tightened, a wedging action occurs that exerts pressure against the bendable margin of the backing disk. The pressure exerted causes the backing disk to bend or flex and conform to the surface of the tone hole. Additional information regarding the design and methods for adjusting the sealing surface of these pads is described in U.S. Pat. No. 4,704,939, the disclosure of which is hereby incorporated by reference.

Inherent in the bending or flexing operation utilized to adjust the pad is the creation of stress on the pad's surface, its retainer, and components of the pad cup. During pad adjustment, more pressure is typically exerted on the more wedged side of the pad surface. As a result, three deleterious effects occur. First, in the region of most wedging, the rigid metal washer presses into the skin making it more taut and increasing its chances of tearing at that point. Second, compression of the pad's surface results as the rigid metal washer opposes the wedging force in the region of maximum adjustment. Finally, as the result of this compression, the pad becomes less resilient in this same region. Each of these effects limit the pad's ability to seal the tone hole with maximum efficiency. The forces created during pad adjustment can also damage components of the pad cup or the pad's retainer. Depending on the amount of wedging required, stress can cause the pad nut to break away from the cup or cause the head of the retainer's screw to break. As will be apparent from the following discussion, this invention provides for a pad cup and retainer capable of withstanding the stress caused by adjustment of the pad because of its greater ability to absorb and dissipate the resulting stress.

Although the pad assemblies of all woodwind instruments suffer from the design limitations or shortcomings described, the design of individual instruments can place additional demands on the pad assemblies. For example, the flute's tone hole with its perpendicular wall is located substantially above the instrument's body and can accommodate a pad having a more exposed outer rim. In contrast, the tone holes for woodwinds with wooden bodies are not perpendicular to the instrument's body, but taper gradually away from the pad's surface. As a result, upon closure of the tone hole, contact between the outer rim of the pad and the wall of the tone hole is more likely to occur, damaging the skin covering the outer rim of the pad and causing a clicking sound. Although a soft pad surface can better conform to the tone hole providing for a better and quieter seal, pads with a soft non-firm felt backing becomes non-planar when the skin covering is stretched over the backing and glued to the back side of the backing disk causing a poor seal.

A preferred pad for a clarinet, a saxophone, or other woodwind instrument would have a felt cushion comprising a soft but firm outer region, a softer region over the tone hole, and a firm central region centered over the tone hole. Such a backing would minimize deformation of the pad's surface because of its improved dimensional stability; allow the pad to remain flat during its lifetime by providing maximum support for the skin covering at the pad's outer circumference; and minimize wear and abrasive damage produced by contact of the pad's outer circumference with cleaning cloths, sharp objects, or the tone hole. In addition, this backing would provide for optimum seal at the tone hole's sealing surface and minimum noise resulting from closure of the tone hole. Finally, the pad's firm central region would optimize tone produced by the instrument.

SUMMARY

One embodiment of the present invention is directed to a pad cup and retainer capable of absorbing and dissipating the stress created when the pad is adjusted by triangulation or the outer margin of a pad's backing disk is bent or wedged to conform the pad's surface to the surface of a tone hole. The pad cup comprises a shallow cup and a pad nut centrally located within. Although the sides of the pad nut can assume any form, one on which sides are straight or which are curved inward to create a narrow mid-region approximately half way between its top and bottom is preferred. In one series of embodiments, the side of the pad nut in contact with the pad cup can be either flat or curved and be either smooth or ridged and in a second embodiment, it can be flanged. Two methods can be used to attach the pad nut to the cup. First, the pad nut can be bonded directly to the bottom of the cup. Methods of bonding may include soldering, gluing, or welding. The presence of ridges on the pad nut's lower surface strengthens the bond and enables it to withstand increased stress developed during pad adjustment. Alternatively, the pad nut, having a flanged region opposite its curved tip, can be inserted into a washer having a recessed region capable of receiving the pad nut's flanged region and the washer and nut combination bonded to the interior surface of the pad cup's end-plate. For both embodiments, the tip of the pad nut is symmetrically curved.

The device holding the pad into the cup can be either a two-piece or one-piece retainer. The two-piece retainer comprises a) a saucer shaped washer having at its center a symmetrically curved region, the first side of which coincides with the curved tip of the pad nut and b) a fastener having both a head, the lower or first side of which is symmetrically curved to coincide with the central curved region of the washer's second side, and means for attachment to the pad nut attached to the head's first side. The curved surfaces on the tip of the pad nut, both sides of the washer, and the lower side of the retainer's head are sized and shaped to allow the washer to pivot radially on the tip of the pad nut to dissipate stress caused when pad adjustments are made. The one-piece retainer comprises a circular planar disk attached to the tip of a modified pad nut through a ball and socket arrangement.

In a preferred embodiment, the pad's sealing surface and the upper surface of the washer-retainer combination form a nearly planar surface and the underneath or first side of the fastener's head closely coincides with the upper curved area of the washer without creating unwanted air gaps which can distort the instrument's tone. As a result, instruments equipped with pads designed according to the preferred embodiment of this invention have improved tone quality and a faster response.

A further embodiment of this invention is directed to an improved pad assembly for woodwind instruments such as the clarinet, oboe, bassoon, or saxophone. The pad is constructed by first placing a soft felt backing over a backing plate having a circular ridge at or near its outer circumference and a raised region located centrally opposite the tone hole and then flattening the felt's surface with a hot iron. The height of the ridge or raised regions is determined by the compressibility of the felt. The pad backing which results after the ironing step has compressed regions opposite the circular ridge and the central raised regions making them more firm. In contrast, the uncompressed region above the tone hole's sealing surface remains soft. As a result, less distortion and a more level pad surface results when the skin or membrane is stretched over the pad backing. In addition, the pad surface over the tone hole sealing surface remains soft providing the optimum seal without the production of unwanted noise. Finally, the more firm region centrally located over the tone hole produces a more resonant tone. As will become apparent from the description which follows, the height and shape of the ridge and central raised region can be varied to produce the effect needed for each different tone hole on several instruments. A novel method for attaching the felt and leveling its surface is taught which produces this new level pad compressed to optimize performance.

DRAWINGS

These and other features, aspects, and advantages of this invention will become better understood with regard to the following description, appended claims and accompanying drawings where:

FIG. 1*a* shows longitudinal views of a portion of a pad cup and a pad nut, the pad nut having a grooved concave surface bonded to the end plate of the pad cup;

FIG. 1*b* shows an end-view of the pattern of circular grooves in the pad nut from FIG. 1*a;*

FIG. 1*c* shows a longitudinal view of a pad cup and a pad nut having a planar smooth surface bonded to a planar end plate with a cyanoacrylate adhesive;

FIG. 1*d* shows a longitudinal view of a flanged pad nut and washer combination suitable for bonding to the end plate of a pad cup;

Figure 13:
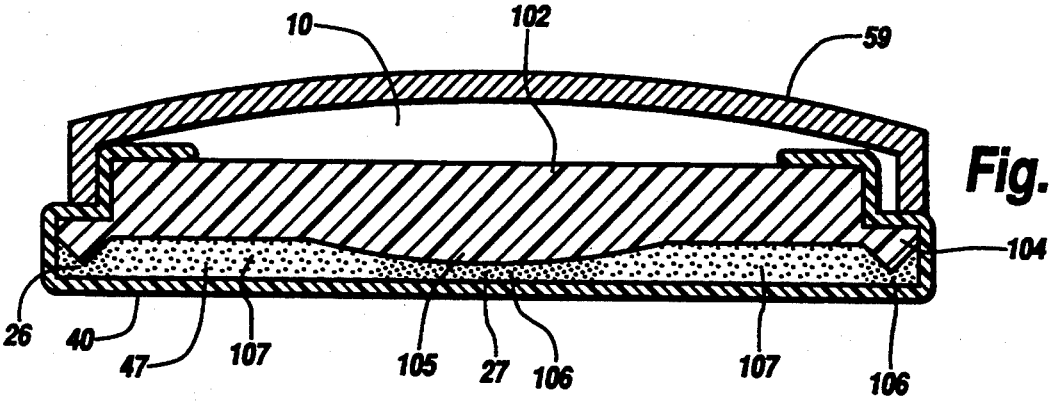
Figure 13A:
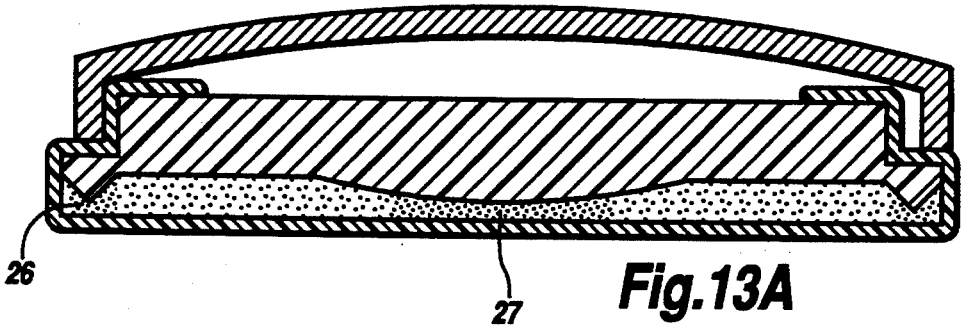
Figure 14A:
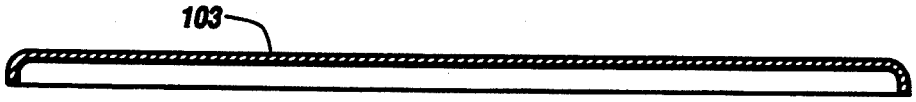
Figure 14B:
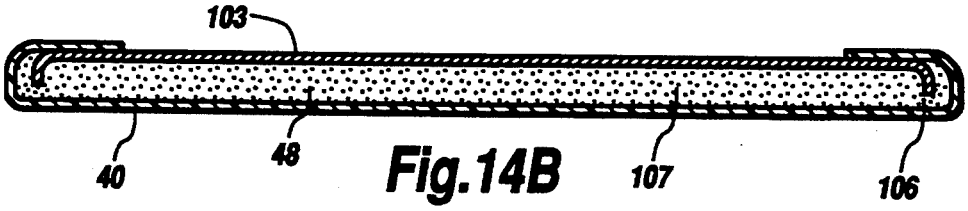
Figure 15:
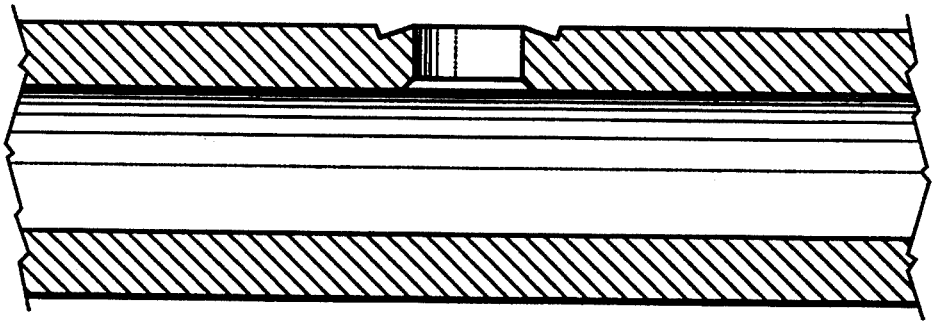
Fig.15 (PRIOR ART)
Figure 16:
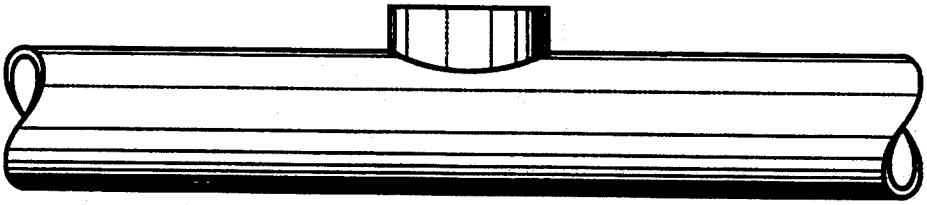
Fig.16 (PRIOR ART)

FIGS. 13 and 13*a* shows an improved pad assembly suitable for covering tone holes of wooden-bodied instruments such as a clarinet;

FIG. 14*a* shows a backing disk suitable for a flute, clarinet, or other woodwind instrument, wherein the outer circumference of the backing disk is curved to become nearly perpendicular to the central planar region of the disk;

FIG. 14*b* shows the backing disk illustrated in FIG. 14*a* covered with a flattened layer of felt backing;

FIG. 15 shows a conventional tone hole for a woodwind instrument, for example a clarinet, oboe, or bassoon; and FIG. 16 shows a conventional tone hole for a silver or metal bodied instrument, for example a flute.

DESCRIPTION

For the purposes of promoting an understanding of the principles of this invention, reference will now be made to several embodiments and specific language will be used to describe the same. It will nevertheless be understood that no limitation of the scope of the invention is thereby intended, such alterations and further modifications and applications of the principles of the invention as described herein being contemplated as would normally occur to one skilled in the art to which the invention relates.

As used herein and illustrated in FIGS. 2 through 11, the term pad cup refers to a shallow cylindrical cup having a cylindrical wall 12 and an end plate 13 attached to one side and a pad nut located within the pad cup attached centrally, either directly or indirectly, to the inside of the end plate. The walls and end plate of the pad cup are made of, for example, silver, nickel silver, or brass having a thickness of about 0.5 to 1.0 mm. Its depth and diameter are determined by the thickness of its pad assembly and the diameter of the tone hole being covered. The pad nut, sometimes referred to as a spud or pad boss, is a short column having either a central cavity suitable for receiving and retaining the shaft of a fastener associated with a retainer or having other means for securing a retainer. Typically, the pad nut is made of brass, however, depending on its design other metals and polymeric materials are envisioned as being suitable. The term retainer refers to a saucer shaped washer and fastener combination or a single device capable of retaining the pad assembly within the pad cup. A backing disk and cushion layer covered with one or more layers of a sealing skin make up the pad assembly.

One embodiment of this invention utilizes a pad cup having a novel pad nut that either alone or in combination with novel retainers can better withstand and dissipate increased stress created when the pads of a woodwind instrument are adjusted. The manner of the pad nut's attachment and shape of the pad nut and retainer combination account for its greater ability to withstand the stress resulting from pad adjustment.

Figure 1A:
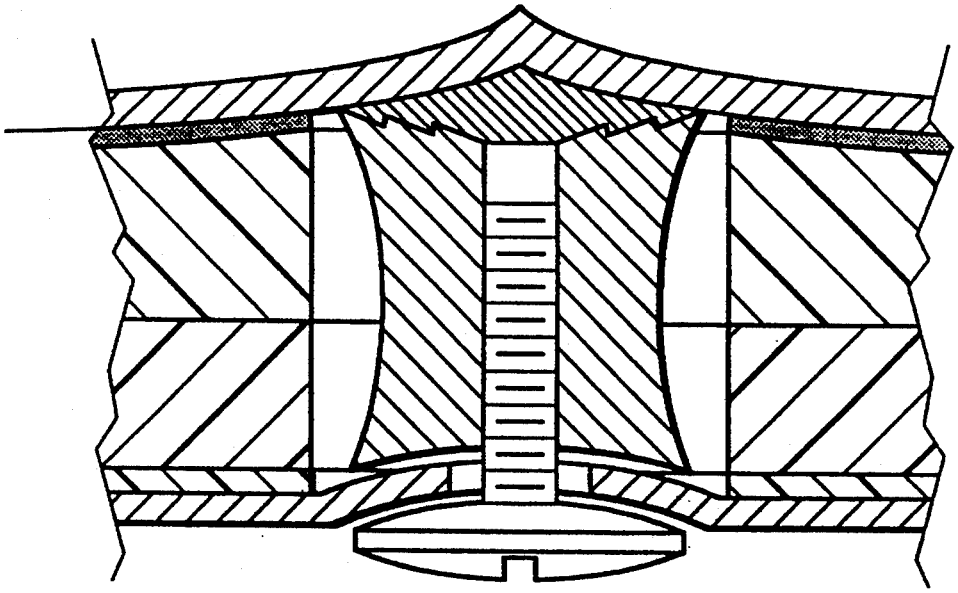
Figure 1B:
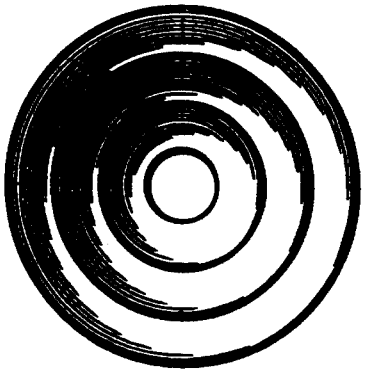

The pad nut can be bonded directly to the endplate with solder, an adhesive, or by welding. Although its bonding surface can take on various geometries, a circular surface that is generally planar, concave, or convex and is either smooth or ridged is preferred. The pad nut's thickness can be uniform from its bonding surface to its tip or it can have a narrow "waist like" region midway between these two surfaces. The preferred pad nut for bonding with solder and most adhesives illustrated in FIG. 1*a* has a bonding surface that is circular and concave with two or more rows of circular ridges. In addition, the preferred pad nut in FIG. 1*a* narrows approximately midway between the bonding surface and the tip providing maximum surfaces for bonding and supporting the retainer and minimizing the pad nut's weight. FIG. 1*b* illustrates the pattern of grooves in the bonding surface of the pad nut shown in FIG. 1*a*.

Figure 1C:
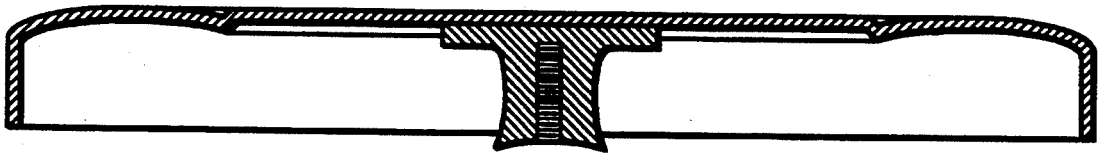

FIG. 1*c* illustrates a pad nut with a smooth planar bonding surface that coincides with the interior surface of the end plate. This pad nut is preferred for bonding with a cyanoacrylate adhesive commonly referred to as superglue.

Figure 1D:
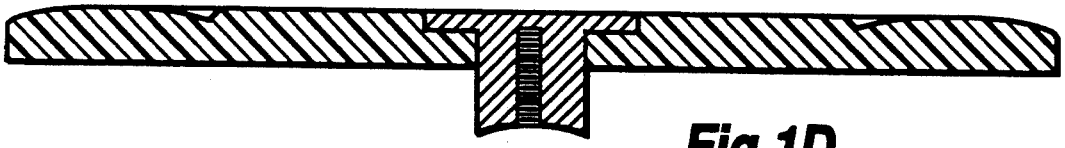

FIG. 1*d* illustrates a pad nut and washer combination wherein the combination is attached to the endplate with an adhesive layer sufficiently thick to allow for leveling of the pad. Suitable adhesives include, but are not limited to, hot melt glues, epoxy resins, and polyurethanes. The combination illustrated in FIG. 1*d* comprises a pad nut of uniform thickness having a flanged region at its bonding surface which is inserted into the central cavity of a thick washer having a flanged recess to receive the flanged region of the pad nut. The washer's thickness can vary between 0.010 to 0.100 of an inch, but is preferably between 0.045 to 0.065 of an inch. Although the washer can be made from a variety of materials, DELRIN, a polyoxymethylene (acetal) available from the Ensinger Corporation, 265 Meadowlands Blvd., Washington, Pa. 15301, is currently the material of choice. DELRIN is a registered trademark of E. I. duPont de Nemours & Company, Wilmington, Del. 19898.

Further embodiments of this invention wherein the pad nut's tip and the retainer have been modified are able to dissipate the stress created when pad adjustments are made. This is accomplished by allowing a two piece retainer comprising a washer and fastener or a one piece retainer to tilt or pivot on the tip of the pad nut with the pad assembly being adjusted. Several embodiments of this invention are illustrated in FIGS. 2 through 11.

Figure 2:
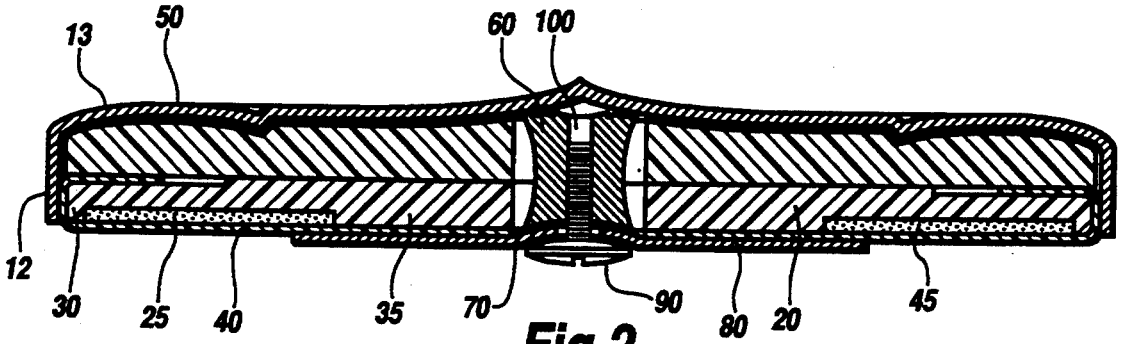
FIGS. 2 and 3 show longitudinal views of tone hole covering assemblies having pad nuts with curved tips and two-piece retainers comprising washers with curved surface regions secured to the pad nut's tips with screw fasteners, the underneath side of the fastener's head being similarly curved and FIG. 2 further illustrates a pad assembly P.
Figure 3:
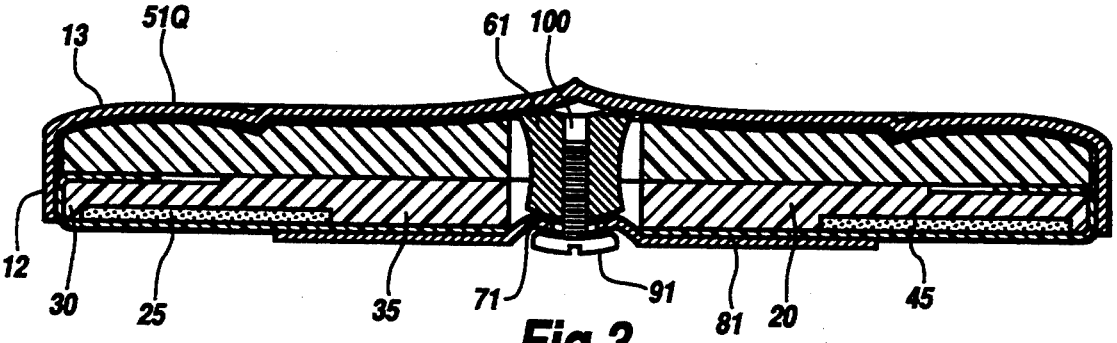

Referring to FIGS. 2 and 3, the pad P comprises a backing disk 20, having a ring-like cushion 45, contained within a recess 25, intermediate a peripheral rim or outer collar 30 and a coaxial central or inner collar 35. A covering 40, of a conventional material such as Goldbeater's skin or zephyr skin is disposed across the radial faces of the collars and peripherally folded around the backing disk to be inwardly folded over the upper side and secured as by gluing.

The assemblies thus described are contained within pad cups 50 and 51, having improved pad nuts 60 and 61, each pad nut having a threaded cylindrical cavity 100, and symmetrically curved tips, 70 and 71. The pad assemblies are retained within the pad cups by washers 80 and 81, having symmetrically curved central regions, and screws 90 and 91, having threaded shafts and heads, the underneath sides of which heads are also symmetrically curved. The hole located at the center of the washer is either round or oval in shape, sufficiently large to allow insertion of the screw's threaded shaft, and in addition, sufficiently large to allow the washer to move from side to side beneath the screw's head. Finally, the symmetrically curved central region of the washer extends outward beyond the curved regions of the pad nut's tip and the lower side of the screw's head to enable the washer to tilt or pivot under the screw's head. The magnitude of the washer's movement is limited by these two factors: the amount that the diameter of the washer's hole exceeds the diameter of the fastener's shaft and, the amount the curved surfaces of the washer extend beyond the curved surfaces of the tip of the pad nut and the head of the fastener. Typically, the diameter of the washer's hole is 0.015 to 0.0.125 of an inch greater than the diameter of the retainer's shaft or more preferably 0.025 to 0.075 of an inch greater than the diameter of the retainer's shaft. The curved surface of the washer should extend from 0.002 to 0.040 of an inch or more preferably 0.010 to 0.020 of an inch beyond the tip of the pad nut and the head of the fastener.

In FIG. 2, the tip of the pad nut 60, is concave, the inner curved region of the washer 80 in contact with the tip of the pad nut, is convex, the outer curved region of the washer 80 opposite the tip of the pad nut, is concave, and the underneath side of the fastener's head 90 in contact with the washer, is convex to enable each of the surfaces to coincide when the pad cup and retainer are assembled and to allow the washer to tilt or pivot on the tip of the pad nut until the fastener has been secured. In FIG. 3, the tip of the pad nut 61, is convex, the inner curved region of the washer 81, is concave, the outer curved region of the washer 81, is convex, and the underneath side of the fastener's head 91, is concave to enable each of the surfaces to coincide when the pad cup and retainer are assembled and to allow the washer to pivot on the pad nut's tip until the fastener has been secured.

Figure 4:
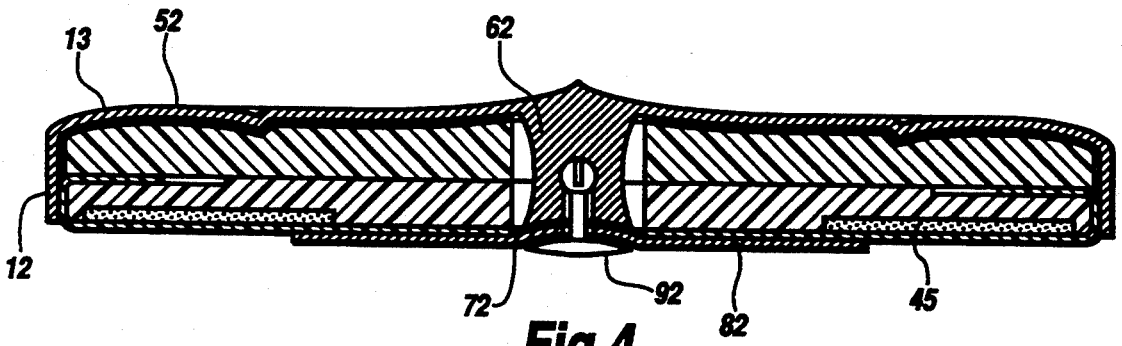
FIGS. 4 and 5 show longitudinal views of tone hole covering assemblies having pad nuts with curved tips and two-piece retainers comprising washers with curved surface regions, the washers secured to the pad nut's tips with snap-on fasteners, the underneath side of the fastener's head being similarly curved.
Figure 5:
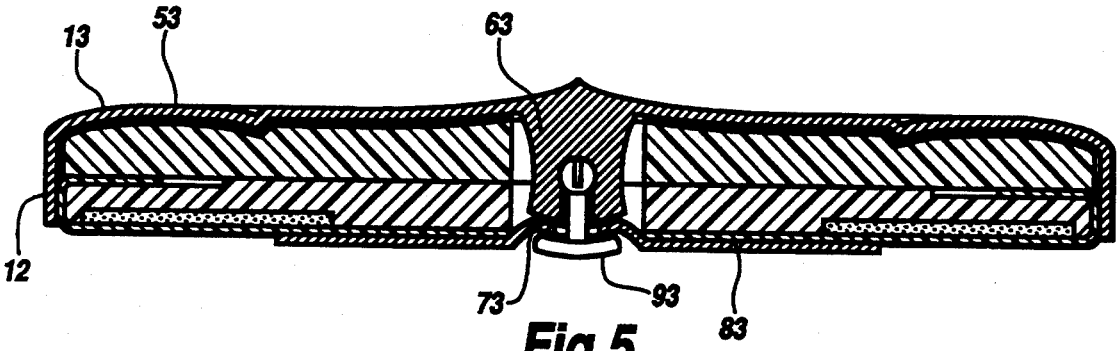

FIGS. 4 and 5, illustrate the use of retainers comprising the same curved washers 80 and 81, in combination with flanged fasteners 92 and 93, attached to pad nuts 62 and 63, modified to receive and retain the flanged fasteners. Each of the fasteners 92 and 93, has at least two slide slits cut at the end of its shaft with a large diameter flanged portion located between its head and the tip of the shaft. The pad nuts 62 and 63, have cylindrical cavities opening centrally on the tips of the pad nuts and enlarging within the cavity into flanged regions to receive and retain the fastener's flanged shafts. As previously illustrated, the tip of the pad nut, the upper and lower curved regions of the washer, and the lower side of the nut's head are curved so that these surfaces coincide and the hole in the center of the washer is sufficiently large to allow the washer to pivot or tilt on the tip of the pad nut. The dimension requirements described for the washers 80 and 81 and the head of retainers 90 and 91 in FIGS. 2 and 3 are applied to washers 82 and 83 and retainers 92 and 93 in FIGS. 4 and 5 so that the washers 82 and 83 can pivot or tilt when pad adjustments are made.

Figure 6:
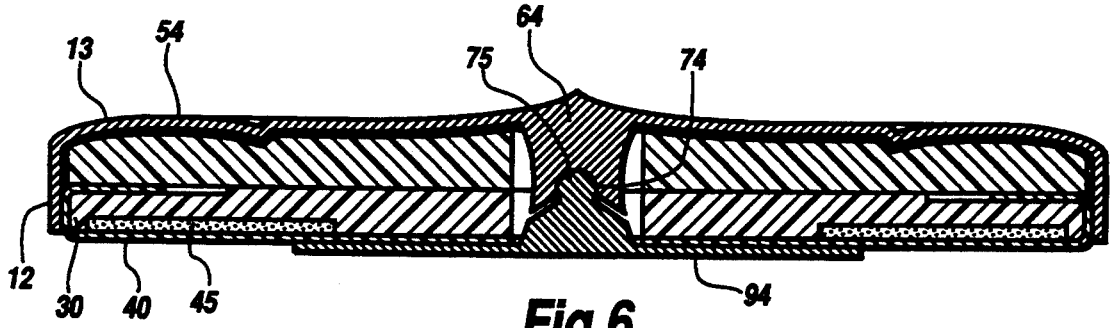
FIGS. 6 and 7 show longitudinal views of tone hole covering assemblies utilizing single piece retainers secured to the tips of the pad nuts through ball and socket mechanisms.
Figure 7:
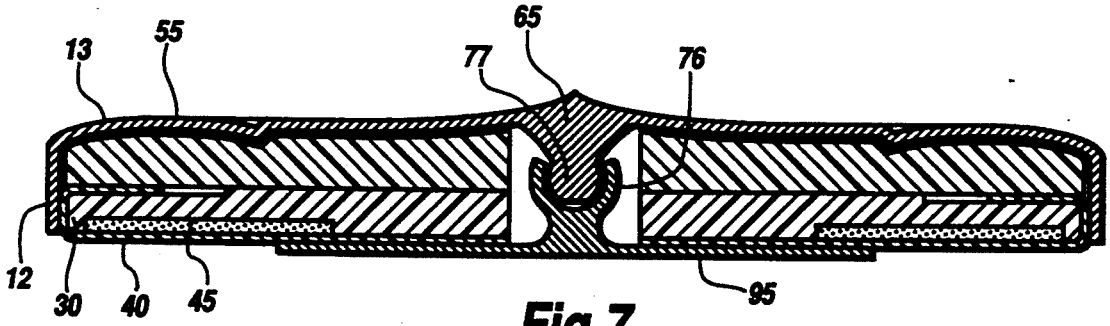

FIGS. 6 and 7 illustrate one piece retainers 94 and 95, attached to the tips of pad nuts 64 and 65 through ball and socket arrangements. Both retainers are comprised of flat circular disks having shafts centrally attached to its flat surface. The one piece retainer's shaft is shorter than two piece retainer's shaft. Either a ball or a socket structure is attached to the tip of each of the retainer's shafts. The tip of pad nuts 64 and 65, have complimenting ball (75 and 77) or socket (74 and 76) structures suitable for receiving and retaining the retainers and shafts. Both retainers 94 and 95 are able to tilt or pivot on the pad nut's tip to relieve the stress caused by adjusting the pad.

Figure 8:
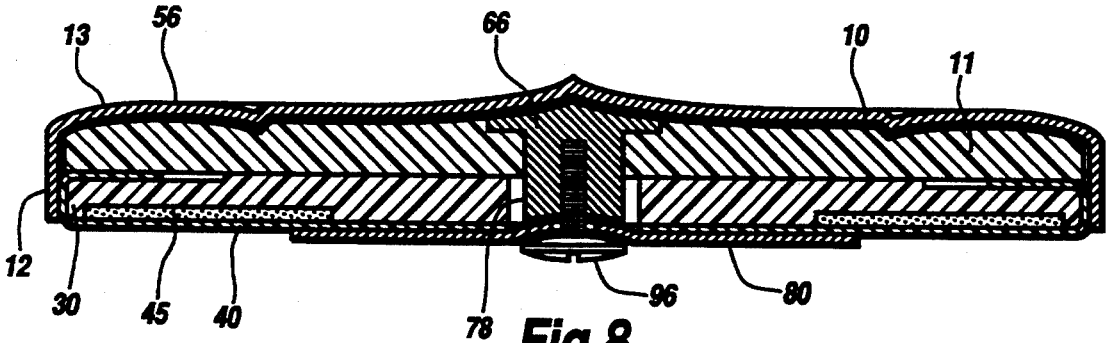
FIGS. 8 and 9 show longitudinal views of tone hole covering assemblies with flanged pad nuts inserted into thick washers, the combinations glued to the end-plates of pad cups and two-piece retainers comprising washers with curved surface regions secured to the tips of the pad nuts with screw fasteners, the underneath sides of the fastener's heads being similarly curved.
Figure 9:
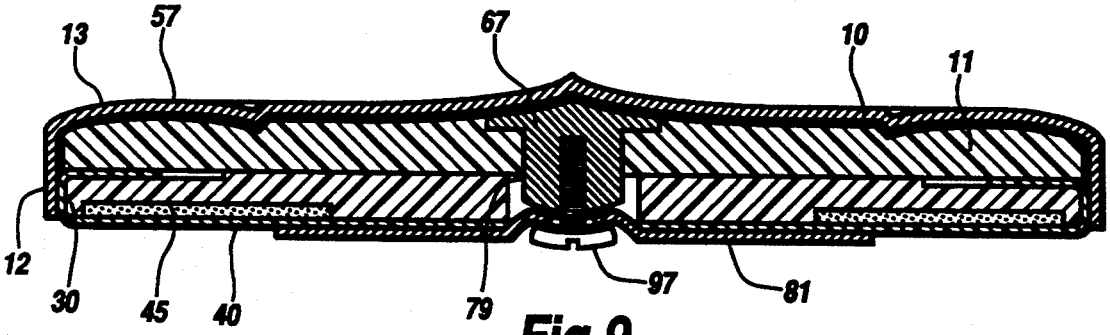

FIGS. 8 and 9 illustrate the pad assembly utilizing pad nuts 66 and 67, illustrated in FIG. 1*d*, each held in place with a layer of adhesive 10 of sufficient thickness to allow for initial adjusting of the pad over the tone hole. The pad nuts 66 and 67 have straight sides and a flanged region opposite their curved tips 78 and 79. The pad nut's height is determined by the depth of the pad and thickness of the washer. The pad nut's height is selected so that its tip is positioned to receive the retainer and the pad nut retainer combination is positioned to maintain the pad assembly within the pad cup and allow the tone hole to be effectively closed. The pad nut is inserted into a washer 11, flat on at least one side, sized and shaped to fit into a pad cup (56 or 57). The pad nut is inserted into the washer's central cavity from a side opposite a flat side of the washer. The washer's central cavity is sized to receive the pad nut and allow minimum play or movement and has a flanged region opposite a flat side of the washer. The flanged region is sized and shaped to receive the flanged region of the pad nut. Although the flanged end of the pad nut can protrude from the washer slightly or fit further up inside the washer leaving a cavity below the flanged end of the pad nut, a pad nut and washer combination wherein the flanged end of the pad nut and the washer are flush at the flange's circumference and the combination coincides with the shape of the endplate is preferred. The thickness of the washer and the depth of the flanged region within the washer's cavity depend primarily on the thickness of the pad cup and strength of the materials of construction. The washer can be constructed of metals such as brass or polymeric materials. A material of choice is DELRIN, manufactured by the Ensinger Corporation. Although the thickness of the washer 11 for a flute pad, constructed of DELRIN can vary in thickness, it typically ranges between 0.020 and 0.050 inches at the backing disk's outer circumference.

Figure 10:
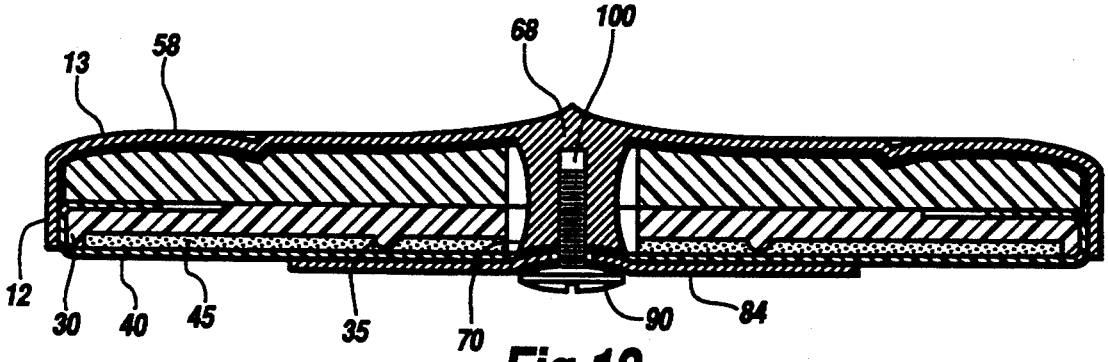
FIG. 10 shows a pad assembly wherein the felt backing extends inward over the inner collar of the backing disk.

FIG. 10 illustrates a pad assembly of the type disclosed in U.S. Pat. No. 4,704,939, wherein the felt backing 45 has been extended over the inner collar 35 of the backing disk. Improved dimensional support for the pad surface develops as a result. The height of the inner collar 35 can be varied to alter the level of increased support desired and varies according to the compressibility of the felt backing. Generally, the inner collar's height should approximate the difference between the felt backing's thickness and the sum of its compressed thickness and the thickness of the washer 84.

Figure 11:
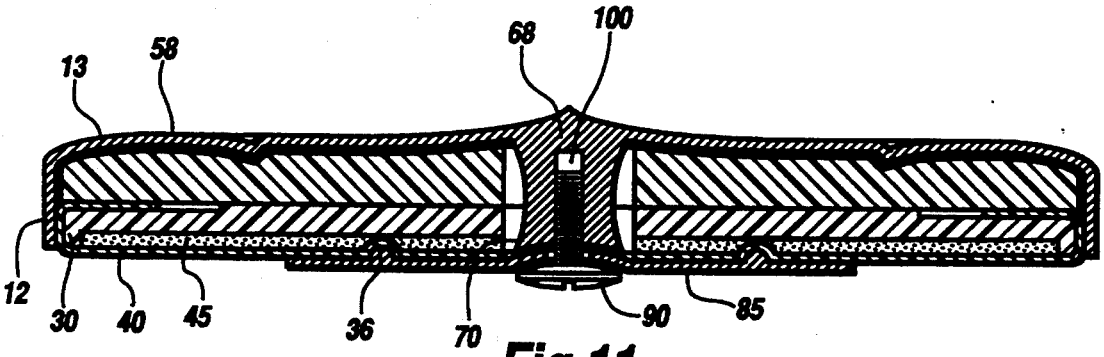
FIG. 11 shows a pad assembly having a backing disk without an inner collar and with a cushion ring covered with skin held in place with a retainer having a circular ridge located on its surface in contact with the pad surface near the inner edge of the pad surface.

FIG. 11 shows an alternative embodiment that achieves similar dimensional support for the inner region of the pad surface. Here, the inner collar has been eliminated and the felt backing 45 extended over the area formerly occupied by the inner collar of the backing disk. A circular ridge 36 located on the retainer's inner surface in contact with the pad surface 40 compresses the felt backing in the region formerly occupied by the inner collar. As in the pad assembly shown in FIG. 10, the height of the ridge 36 can be varied to create the desired level of increased support desired. The formula $R=D-C-W$ can be used to approximate the height of the ridge R, where D is the thickness of the uncompressed backing 45, C is the thickness of the backing when compressed, and W is the thickness of the retainer 85 adjacent to the ridge.

Figure 12:
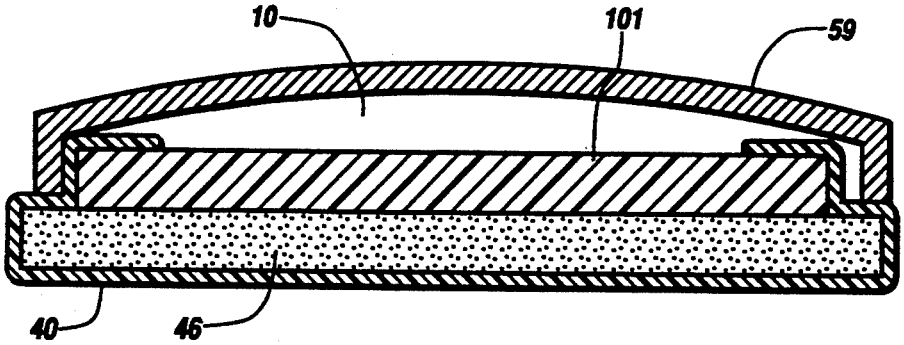
Fig.12 (PRIOR ART)
FIG. 12 shows a conventional pad assembly suitable for covering the tone hole of a clarinet.

FIG. 12 illustrates a conventional tone hole closure used for a clarinet or other woodwind instrument wherein a pad assembly comprises a layer of felt 46 attached to a cardboard back 101, the combination covered with a skin or membrane 40. The pad assembly is held in place in the pad cup 59 with a layer of hot-melt glue or other adhesive 10. The tone hole closure illustrated in FIG. 12 has a pad surface which is uniformly soft or firm over its entire surface.

FIGS. 13 and 13*a* illustrate a pad assembly having a firm outer region 106, a softer mid-region above the tone hole 107, and a firm central region 106. This variation in the firmness of the pad surface is accomplished by supporting the felt backing 47 with a backing disk 102 having in contact with felt, an outer circular ridge 104 and a central raised region 105. The felt backing is first attached to the backing disk 102 with a conventional adhesive or a sheet glue and flattened with a hot iron or similar tool capable of delivering heat with or without steam. A sheet glue found to be particularly effective is 950 Adhesive Transfer Tape manufactured by 3M, St. Paul, Minn. Once the felt backing has been flattened and compressed, one or more layers of skin or other covering 40 are stretched over the pad's surface and glued to it's back. Finally, the pad can be fastened to the pad cup 59 with a layer of hot-melt glue or other adhesive 11 and leveled by conventional means.

The novel backing disk can be metal, plastic, or other material sufficiently rigid and capable of being either machined, forged or molded. Backing disks made from DELRIN, are preferred. The height and shape of the outer circular ridge and the inner raised region vary according to the particular felt backing used and the amount of support desired. The effect of the ridge is to give increased rigidity to the felt covering the ridge 26 and thus increased support for the skin or membrane covering. The effect of the raised region is to increase the rigidity of the felt covering the raised region 27 and change the acoustical properties of the pad surface. Sufficient compression of the felt backing has been achieved with a blunt, curved or sharp ridge. However, preliminary studies indicate that a sharp ridge is preferred. A preferred backing disk for a B flat, A, or E flat clarinet comprises a DELRIN disk having a sharp outer circular ridge and a circular raised region centrally located. The outer ridge is located within about 0.005 inches of the backing disk's outer circumference, the ridge's height being between about 0.005 and 0.020 inches high. Similarly, the inner raised region can be circular, can have a blunt, curved, or sharp surface, and can be between about 0.005 and 0.020 inches high. A circular piece of felt is glued to the surface of the backing disk, ironed flat, and covered with Goldbeater's skin. The resulting pad is placed in a pad cup and leveled by conventional means. This pad has a firm outer region that resists deformation when the skin is stretched over the felt backing but is soft enough to resist abrasion during cleaning or unintentional contacts. The region of the pad surface directly over the tone hole walls remains soft to provide for an optimum seal and minimum noise when the tone hole is closed. Finally, the inner region of the pad's surface centered over the tone hole's cavity is firm to optimize the instrument's tone.

Similar pads for a saxophone and a bassoon comprising a backing disk with an outer circular ridge and an inner circular raised region, a felt covering compressed above the ridge and circular region, and finally one or more layers of a skin or membrane covering resist deformation and have demonstrated improved wear, quieter operation, and improved tone quality. A preferred covering for saxophone pads is kidskin.

Although pads having a felt covered backing disk with both the outer circular ridge and the inner circular region are preferred, improved performance can be achieved with a backing disk having only the outer ridge or only the inner raised region and both embodiments are within the scope of this invention.

A further embodiment comprises a pad assembly illustrated in FIG. 14*a* having a backing disk 103 wherein the outer circumference of the planar circular disk curves becoming nearly perpendicular to the central planar region of the disk and rises to from 0.005 to 0.020 inches above the planar region. The backing disk illustrated in FIG. 14*b* can be constructed from a metal capable of being stamped such as brass or aluminum or a polymeric material capable of being hot stamped. If desired, a central raised region can be added during the stamping process or by bonding a separate piece of metal or polymer between 0.005 and 0.020 inches high to the central region of the disk. Bonding methods can include welding, soldering, or gluing. A circular piece of felt backing 48 having a diameter approximately 0.005 to 0.030 of an inch greater than the backing disk is attached to the backing disk and ironed smooth as described above. Next, one or more layers of skin or other covering is stretched over the felt backing, wrapped around the edge of the assembly and bonded to the back of the backing disk. Finally, the pad assembly is placed in a pad cup and leveled by conventional means. Pad assemblies utilizing these improved backing disks have demonstrated improved resistance to wear at the pad's outer circumference and have provided an optimum seal with minimum noise when the tone hole is closed. With a central raised region, the pad assembly produces a more resonant tone.

I claim:

1. A pad for closure of a wind instrument tone hole, comprising a backing disk; a layer of felt backing attached to a first side of the backing disk, the felt having a more dense compressed region exterior to a less dense un-compressed region positioned to impact the tone hole upon closure; and at least one layer of a sealing material covering the felt backing, the sealing material attached to a second side of the backing disk.

2. A pad for closure of a wind instrument tone hole as set forth in claim 1, wherein the backing disk has a peripheral ridge beneath the layer of felt backing.

3. A pad for closure of a wind instrument tone hole as set forth in claim 2, wherein the backing disk has a central raised region beneath the layer of felt backing.

4. A pad as set forth in claim 2, wherein the height of the peripheral ridge is between 0.005 and 0.002 inches high.

5. A pad as set forth in claim 4, wherein the peripheral ridge is within 0.035 of an inch from the outer circumference of the backing disk.

6. A pad as set forth in claim 2, wherein the peripheral ridge narrows opposite the backing disk to form a sharp edge in contact with the felt backing.

7. A pad as set forth in claim 2, wherein the peripheral ridge has a curved edge in contact with the felt backing.

8. A pad as set forth in claim 2, wherein the peripheral ridge has a blunt edge in contact with the felt backing.

9. A pad for closure of a wind instrument tone hole as set forth in claim 1, wherein the outer circumference of the backing disk curves in the direction of the felt backing and the felt backing extends beyond the backing disk's outer circumference.

10. A pad as set forth in claim 1, wherein the felt backing is attached to the backing disk with an adhesive.

11. A pad as set forth in claim 10, wherein the adhesive is a sheet adhesive.

* * * * *